US008238770B2

(12) United States Patent
Shimizu

(10) Patent No.: US 8,238,770 B2
(45) Date of Patent: Aug. 7, 2012

(54) FIXING DEVICE AND IMAGE FORMING APPARATUS

(75) Inventor: Yosuke Shimizu, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 393 days.

(21) Appl. No.: 12/481,637

(22) Filed: Jun. 10, 2009

(65) Prior Publication Data

US 2009/0317100 A1 Dec. 24, 2009

(30) Foreign Application Priority Data

Jun. 20, 2008 (JP) ..... 2008-161532

(51) Int. Cl.
*G03G 15/20* (2006.01)
*G03G 21/20* (2006.01)

(52) U.S. Cl. ..... 399/33; 399/330; 399/334; 399/337

(58) Field of Classification Search ..... 399/33, 399/328, 330, 331, 334, 336, 337
See application file for complete search history.

(56) References Cited

U.S. PATENT DOCUMENTS

| | | | | |
|---|---|---|---|---|
| 6,661,991 | B2 * | 12/2003 | Naito et al. | 399/328 |
| 6,810,220 | B2 * | 10/2004 | Hamada et al. | 399/69 |
| 6,850,728 | B2 * | 2/2005 | Yokozeki et al. | 399/328 |
| 6,882,807 | B2 * | 4/2005 | Sakagami | 399/69 |
| 6,965,741 | B2 * | 11/2005 | Senda | 399/33 |
| 7,010,255 | B2 * | 3/2006 | Yura et al. | 399/328 |
| 7,187,899 | B2 * | 3/2007 | Cao et al. | 399/328 |
| 7,333,743 | B2 * | 2/2008 | Kishi et al. | 399/69 |
| 7,333,760 | B2 * | 2/2008 | Baba et al. | 399/307 |
| 7,349,660 | B2 * | 3/2008 | Domoto et al. | 399/328 |
| 7,430,395 | B2 * | 9/2008 | Iwaishi et al. | 399/336 |
| 7,747,195 | B2 * | 6/2010 | Yoshino et al. | 399/122 |
| 7,764,916 | B2 * | 7/2010 | Kagawa | 399/334 |
| 2007/0036571 | A1 | 2/2007 | Kagawa et al. | |

FOREIGN PATENT DOCUMENTS

| | | | |
|---|---|---|---|
| CN | 1853145 | | 10/2006 |
| JP | 62267788 | A * | 11/1987 |
| JP | 07064420 | A * | 3/1995 |
| JP | 8-248812 | | 9/1996 |

(Continued)

OTHER PUBLICATIONS

First Office Action dated Oct. 15, 2010, issued in the corresponding Chinese Patent Application No. 200910142499.9, and an English Translation thereof.

(Continued)

*Primary Examiner* — David Gray
*Assistant Examiner* — Fred L Braun
(74) *Attorney, Agent, or Firm* — Buchanan Ingersoll & Rooney PC

(57) ABSTRACT

A fixing device includes a fixing roller, a pressure roller and a soaking roller. Temperature of the soaking roller, which contacts with the pressure roller, is measured by a temperature measurement section. This makes it possible to precisely estimate the temperature distribution of the fixing roller and the pressure roller including a non-paper feed area of paper sheets. Based on the temperature of the soaking roller, fixing operation is controlled by a fixing operation control section. Thereby, optimal control can be implemented to suppress the temperature rise in the non-paper feed area according to the estimated temperature distribution of the fixing roller and the pressure roller.

17 Claims, 10 Drawing Sheets

FOREIGN PATENT DOCUMENTS

| | | | | |
|---|---|---|---|---|
| JP | 10-074017 | A | | 3/1998 |
| JP | 11258939 | A | * | 9/1999 |
| JP | 2001154517 | A | * | 6/2001 |
| JP | 2001-201978 | A | | 7/2001 |
| JP | 2002357981 | A | * | 12/2002 |
| JP | 2003-345167 | A | | 12/2003 |
| JP | 2004-157503 | A | | 6/2004 |
| JP | 2005-017965 | A | | 1/2005 |
| JP | 2006039049 | A | * | 2/2006 |
| JP | 2007199582 | A | * | 8/2007 |
| JP | 2007-310255 | | | 11/2007 |

OTHER PUBLICATIONS

Preliminary Notice of Rejection issued in the corresponding Japanese Patent Application No. 2008-161532, dated Jun. 15, 2010 and English translation thereof.

Preliminary Notice of Rejection dated Aug. 31, 2010, issued in the corresponding Japanese Patent Application No. 2008-161532, and an English Translation thereof.

* cited by examiner

*Fig.4A*

| SOAKING ROLLER TEMPERATURE | PAPER SHEET INTERVAL |
|---|---|
| ~<95℃ | STANDARD PAPER SHEET INTERVAL |
| 95℃≦~<110℃ | STANDARD PAPER SHEET INTERVAL×1.5 |
| 110℃≦~<125℃ | STANDARD PAPER SHEET INTERVAL×2 |
| 125℃≦~ | STANDARD PAPER SHEET INTERVAL×4 |

*Fig.4B*

| SOAKING ROLLER TEMPERATURE | PAPER SIZE (WIDTH SIZE (mm)) | PAPER SHEET INTERVAL |
|---|---|---|
| ~<95℃ | 265≦~ | STANDARD PAPER SHEET INTERVAL |
| | 240≦~<265 | STANDARD PAPER SHEET INTERVAL |
| | 215≦~<240 | STANDARD PAPER SHEET INTERVAL |
| | 190≦~<215 | STANDARD PAPER SHEET INTERVAL |
| | 90≦~<145 | STANDARD PAPER SHEET INTERVAL |
| 95℃≦~<110℃ | 265≦~ | STANDARD PAPER SHEET INTERVAL |
| | 240≦~<265 | STANDARD PAPER SHEET INTERVAL |
| | 215≦~<240 | STANDARD PAPER SHEET INTERVAL×1.25 |
| | 190≦~<215 | STANDARD PAPER SHEET INTERVAL×1.25 |
| | 90≦~<145 | STANDARD PAPER SHEET INTERVAL×1.5 |
| 110℃≦~<125℃ | 265≦~ | STANDARD PAPER SHEET INTERVAL |
| | 240≦~<265 | STANDARD PAPER SHEET INTERVAL×1.25 |
| | 215≦~<240 | STANDARD PAPER SHEET INTERVAL×1.5 |
| | 190≦~<215 | STANDARD PAPER SHEET INTERVAL×1.75 |
| | 90≦~<145 | STANDARD PAPER SHEET INTERVAL×2 |
| 125℃≦~ | 265≦~ | STANDARD PAPER SHEET INTERVAL×1.5 |
| | 240≦~<265 | STANDARD PAPER SHEET INTERVAL×2 |
| | 215≦~<240 | STANDARD PAPER SHEET INTERVAL×2.5 |
| | 190≦~<215 | STANDARD PAPER SHEET INTERVAL×3 |
| | 90≦~<145 | STANDARD PAPER SHEET INTERVAL×4 |

*Fig.5A*

| SOAKING ROLLER TEMPERATURE | PAPER SHEET CONVEYING SPEED |
|---|---|
| ~<95℃ | STANDARD CONVEYING SPEED |
| 95℃≦~<110℃ | STANDARD CONVEYING SPEED×0.9 |
| 110℃≦~<125℃ | STANDARD CONVEYING SPEED×0.8 |
| 125℃≦~ | STANDARD CONVEYING SPEED×0.6 |

*Fig.5B*

| SOAKING ROLLER TEMPERATURE | PAPER SIZE (WIDTH SIZE (mm)) | PAPER SHEET CONVEYING SPEED |
|---|---|---|
| ~<95℃ | 265≦~ | STANDARD CONVEYING SPEED |
| | 240≦~<265 | STANDARD CONVEYING SPEED |
| | 215≦~<240 | STANDARD CONVEYING SPEED |
| | 190≦~<215 | STANDARD CONVEYING SPEED |
| | 90≦~<145 | STANDARD CONVEYING SPEED |
| 95℃≦~<110℃ | 265≦~ | STANDARD CONVEYING SPEED |
| | 240≦~<265 | STANDARD CONVEYING SPEED |
| | 215≦~<240 | STANDARD CONVEYING SPEED×0.95 |
| | 190≦~<215 | STANDARD CONVEYING SPEED×0.95 |
| | 90≦~<145 | STANDARD CONVEYING SPEED×0.9 |
| 110℃≦~<125℃ | 265≦~ | STANDARD CONVEYING SPEED |
| | 240≦~<265 | STANDARD CONVEYING SPEED×0.95 |
| | 215≦~<240 | STANDARD CONVEYING SPEED×0.9 |
| | 190≦~<215 | STANDARD CONVEYING SPEED×0.85 |
| | 90≦~<145 | STANDARD CONVEYING SPEED×0.8 |
| 125℃≦~ | 265≦~ | STANDARD CONVEYING SPEED×0.9 |
| | 240≦~<265 | STANDARD CONVEYING SPEED×0.8 |
| | 215≦~<240 | STANDARD CONVEYING SPEED×0.75 |
| | 190≦~<215 | STANDARD CONVEYING SPEED×0.7 |
| | 90≦~<145 | STANDARD CONVEYING SPEED×0.6 |

*Fig.6A*

| SOAKING ROLLER TEMPERATURE | HEATING TEMPERATURE |
|---|---|
| ~<95℃ | STANDARD HEATING TEMPERATURE |
| 95℃≦~<110℃ | STANDARD HEATING TEMPERATURE −5℃ |
| 110℃≦~<125℃ | STANDARD HEATING TEMPERATURE −5℃ |
| 125℃≦~ | STANDARD HEATING TEMPERATURE −5℃ |

*Fig.6B*

| SOAKING ROLLER TEMPERATURE | PAPER SIZE (WIDTH SIZE (mm)) | HEATING TEMPERATURE |
|---|---|---|
| ~<95℃ | 265≦~ | STANDARD HEATING TEMPERATURE |
| | 240≦~<265 | STANDARD HEATING TEMPERATURE |
| | 215≦~<240 | STANDARD HEATING TEMPERATURE |
| | 190≦~<215 | STANDARD HEATING TEMPERATURE |
| | 90≦~<145 | STANDARD HEATING TEMPERATURE |
| 95℃≦~<110℃ | 265≦~ | STANDARD HEATING TEMPERATURE |
| | 240≦~<265 | STANDARD HEATING TEMPERATURE |
| | 215≦~<240 | STANDARD HEATING TEMPERATURE −5℃ |
| | 190≦~<215 | STANDARD HEATING TEMPERATURE −5℃ |
| | 90≦~<145 | STANDARD HEATING TEMPERATURE −5℃ |
| 110℃≦~<125℃ | 265≦~ | STANDARD HEATING TEMPERATURE |
| | 240≦~<265 | STANDARD HEATING TEMPERATURE −5℃ |
| | 215≦~<240 | STANDARD HEATING TEMPERATURE −5℃ |
| | 190≦~<215 | STANDARD HEATING TEMPERATURE −5℃ |
| | 90≦~<145 | STANDARD HEATING TEMPERATURE −5℃ |
| 125℃≦~ | 265≦~ | STANDARD HEATING TEMPERATURE −5℃ |
| | 240≦~<265 | STANDARD HEATING TEMPERATURE −5℃ |
| | 215≦~<240 | STANDARD HEATING TEMPERATURE −5℃ |
| | 190≦~<215 | STANDARD HEATING TEMPERATURE −5℃ |
| | 90≦~<145 | STANDARD HEATING TEMPERATURE −5℃ |

Fig.7A

| SOAKING ROLLER TEMPERATURE | PAPER SHEET CONVEYING SPEED | HEATING TEMPERATURE |
|---|---|---|
| ~<95℃ | STANDARD CONVEYING SPEED | STANDARD HEATING TEMPERATURE |
| 95℃≦~<110℃ | STANDARD CONVEYING SPEED×0.95 | STANDARD HEATING TEMPERATURE −5℃ |
| 110℃≦~<125℃ | STANDARD CONVEYING SPEED×0.9 | STANDARD HEATING TEMPERATURE −10℃ |
| 125℃≦~ | STANDARD CONVEYING SPEED×0.8 | STANDARD HEATING TEMPERATURE −15℃ |

Fig.7B

| SOAKING ROLLER TEMPERATURE | PAPER SIZE (WIDTH SIZE (mm)) | PAPER SHEET CONVEYING SPEED | HEATING TEMPERATURE |
|---|---|---|---|
| ~<95℃ | 265≦~ | STANDARD CONVEYING SPEED | STANDARD HEATING TEMPERATURE |
| | 240≦~<265 | STANDARD CONVEYING SPEED | STANDARD HEATING TEMPERATURE |
| | 215≦~<240 | STANDARD CONVEYING SPEED | STANDARD HEATING TEMPERATURE |
| | 190≦~<215 | STANDARD CONVEYING SPEED | STANDARD HEATING TEMPERATURE |
| | 90≦~<145 | STANDARD CONVEYING SPEED | STANDARD HEATING TEMPERATURE |
| 95℃≦~<110℃ | 265≦~ | STANDARD CONVEYING SPEED | STANDARD HEATING TEMPERATURE |
| | 240≦~<265 | STANDARD CONVEYING SPEED | STANDARD HEATING TEMPERATURE |
| | 215≦~<240 | STANDARD CONVEYING SPEED×0.95 | STANDARD HEATING TEMPERATURE −5℃ |
| | 190≦~<215 | STANDARD CONVEYING SPEED×0.95 | STANDARD HEATING TEMPERATURE −5℃ |
| | 90≦~<145 | STANDARD CONVEYING SPEED×0.95 | STANDARD HEATING TEMPERATURE −5℃ |
| 110℃≦~<125℃ | 265≦~ | STANDARD CONVEYING SPEED | STANDARD HEATING TEMPERATURE |
| | 240≦~<265 | STANDARD CONVEYING SPEED×0.95 | STANDARD HEATING TEMPERATURE −5℃ |
| | 215≦~<240 | STANDARD CONVEYING SPEED×0.95 | STANDARD HEATING TEMPERATURE −5℃ |
| | 190≦~<215 | STANDARD CONVEYING SPEED×0.9 | STANDARD HEATING TEMPERATURE −10℃ |
| | 90≦~<145 | STANDARD CONVEYING SPEED×0.9 | STANDARD HEATING TEMPERATURE −10℃ |
| 125℃≦~ | 265≦~ | STANDARD CONVEYING SPEED×0.95 | STANDARD HEATING TEMPERATURE −5℃ |
| | 240≦~<265 | STANDARD CONVEYING SPEED×0.9 | STANDARD HEATING TEMPERATURE −10℃ |
| | 215≦~<240 | STANDARD CONVEYING SPEED×0.85 | STANDARD HEATING TEMPERATURE −15℃ |
| | 190≦~<215 | STANDARD CONVEYING SPEED×0.85 | STANDARD HEATING TEMPERATURE −15℃ |
| | 90≦~<145 | STANDARD CONVEYING SPEED×0.8 | STANDARD HEATING TEMPERATURE −15℃ |

Fig.8A

| SOAKING ROLLER TEMPERATURE | PRINT OPERATION (IN PRINTING) | PRINT OPERATION (IN TEMPORARY STOP) |
|---|---|---|
| ~<85℃ | PRINTING MAINTAINED | TEMPORARY STOP→PRINT RESTART |
| 85℃≦~<95℃ | | TEMPORARY STOP MAINTAINED |
| 95℃≦~<110℃ | PRINT→TEMPORARY STOP | |
| 110℃≦~<125℃ | | |
| 125℃≦~ | | |

Fig.8B

| SOAKING ROLLER TEMPERATURE | PAPER SIZE (WIDTH SIZE (mm)) | PRINT OPERATION (IN PRINTING) | PRINT OPERATION (IN TEMPORARY STOP) |
|---|---|---|---|
| ~<85℃ | 265≦~ | PRINTING MAINTAINED | TEMPORARY STOP →PRINT RESTART |
| | 240≦~<265 | | |
| | 215≦~<240 | | |
| | 190≦~<215 | | |
| | 90≦~<145 | | |
| 85℃≦~<95℃ | 265≦~ | PRINTING MAINTAINED | TEMPORARY STOP →PRINT RESTART |
| | 240≦~<265 | | |
| | 215≦~<240 | | |
| | 190≦~<215 | | |
| | 90≦~<145 | | TEMPORARY STOP MAINTAINED |
| 95℃≦~<110℃ | 265≦~ | PRINTING MAINTAINED | TEMPORARY STOP→PRINT RESTART |
| | 240≦~<265 | | TEMPORARY STOP MAINTAINED |
| | 215≦~<240 | PRINT →TEMPORARY STOP | |
| | 190≦~<215 | | |
| | 90≦~<145 | | |
| 110℃≦~<125℃ | 265≦~ | PRINTING MAINTAINED | TEMPORARY STOP MAINTAINED |
| | 240≦~<265 | PRINT →TEMPORARY STOP | |
| | 215≦~<240 | | |
| | 190≦~<215 | | |
| | 90≦~<145 | | |
| 125℃≦~ | 265≦~ | PRINT →TEMPORARY STOP | TEMPORARY STOP MAINTAINED |
| | 240≦~<265 | | |
| | 215≦~<240 | | |
| | 190≦~<215 | | |
| | 90≦~<145 | | |

*Fig.9A*

| SOAKING ROLLER TEMPERATURE | DEGAUSSING COIL |
|---|---|
| ~<95℃ | OFF |
| 95℃≦~<110℃ | ON |
| 110℃≦~<125℃ | ON |
| 125℃≦~ | ON |

*Fig.9B*

| SOAKING ROLLER TEMPERATURE | PAPER SIZE (WIDTH SIZE (mm)) | DEGAUSSING COIL |
|---|---|---|
| ~<95℃ | 265≦~ | OFF |
| | 240≦~<265 | OFF |
| | 215≦~<240 | OFF |
| | 190≦~<215 | OFF |
| | 90≦~<145 | OFF |
| 95℃≦~<110℃ | 265≦~ | OFF |
| | 240≦~<265 | OFF |
| | 215≦~<240 | ON |
| | 190≦~<215 | ON |
| | 90≦~<145 | ON |
| 110℃≦~<125℃ | 265≦~ | OFF |
| | 240≦~<265 | ON |
| | 215≦~<240 | ON |
| | 190≦~<215 | ON |
| | 90≦~<145 | ON |
| 125℃≦~ | 265≦~ | ON |
| | 240≦~<265 | ON |
| | 215≦~<240 | ON |
| | 190≦~<215 | ON |
| | 90≦~<145 | ON |

FIXING DEVICE AND IMAGE FORMING APPARATUS

CROSS-REFERENCE TO RELATED APPLICATION

This application is based on application No. 2008-161532 filed in Japan, the entire content of which is hereby incorporated by reference.

TECHNICAL FIELD

The present invention relates to a fixing device for use in image forming apparatuses such as copying machines, printers and facsimiles, and to an image forming apparatus using the fixing device.

BACKGROUND ART

Conventionally, there have been a fixing device including a fixing roller and a pressure roller (see JP 10-74017 A). The fixing roller is heated by induction heating. The fixing roller and the pressure roller respectively heats and pressurizes recording paper so as to fix images on the recording paper.

When small-size recording paper is continuously fed, heat is not removed in non-paper feed areas of the fixing roller and the pressure roller. This causes a problem that the temperature of the non-paper feed areas becomes higher than that of paper feed areas.

As a solution to the problem, a temperature sensor which is provided at an end of the fixing roller detects the state of temperature rise in the non-paper feed areas. Based on values that the temperature sensor detects, a cooling fan is operated, and current flow to coils and conveyance of recording materials are stopped.

In the conventional fixing device, a highest-temperature position of the fixing roller in the axial direction thereof varies depending on the size of paper sheets to be fed Therefore, it is difficult to accurately obtain the state of temperature rise in the non-paper feed areas for all sizes of paper sheets including indeterminately formed paper sheets.

Particularly, in the case of feeding the indeterminately formed paper sheets, the state of temperature rise in the non-paper feed area of the fixing roller may be misidentified, which may cause damage such as breakage to the fixing device.

SUMMARY OF INVENTION

An object of the present invention is to provide an image forming apparatus inexpensively capable of detecting rise of temperature in a fixing roller with more sufficient precision so as to effectively control temperature rise in a non-paper feed area and to prevent breakage.

In order to achieve the above-mentioned object, one aspect of the present invention provides a fixing device comprising a fixing-side rotation unit and a pressure-side rotation unit which contact with each other to convey a recording material while fixing toner on the recording material, a heating section for heating the fixing-side rotation unit, a soaking member which contacts with the fixing-side rotation unit or the pressure-side rotation unit, a temperature measurement section for measuring temperature of the soaking member, and fixing operation control section for controlling fixing operation based on the temperature of the soaking member measured by the temperature measurement section.

The wording "control of fixing operation" is herein used to refer to, for example, controlling a conveyance interval of continuously conveyed recording materials, controlling the conveying speed of recording materials, controlling the heating temperature of the heating section, controlling stop or start of the fixing operation, and controlling operation of the heating section.

In the fixing device of the invention, temperature of the soaking member is measured wherein the soaking member contacts the fixing-side rotation unit or the pressure-side rotation unit. The soaking member is excellent in thermal conductivity, so that the soaking member maintains generally flat distribution of temperature in the axial direction even when small-size recording materials are continuously fed. Therefore, measuring a temperature of part of the soaking member makes it possible to identify temperature distribution of the entire region of the fixing-side rotation unit or the pressure-side rotation unit. In short, it is possible to precisely estimate the temperature distribution of the fixing-side rotation unit or the pressure-side rotation unit including the non-paper feed area of the recording material.

The fixing operation is controlled based on the temperature of the soaking member measured by the temperature measurement section. Thus, optimal control can be performed to suppress the temperature rise in the non-paper feed area according to the estimated temperature distribution of the fixing-side rotation unit or the pressure-side rotation unit. This makes it possible to prevent any damage on the fixing device without reducing user-friendliness beyond necessity.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 4A shows a data table for controlling a paper sheet interval;

FIG. 4B shows another data table for controlling the paper sheet interval;

FIG. 5A shows a data table for controlling a paper sheet conveying speed;

FIG. 5B shows another data table for controlling of the paper sheet conveying speed;

FIG. 6A shows a data table for controlling heating temperature;

FIG. 6B shows another data table for controlling of the heating temperature;

FIG. 7A shows a data table for controlling the paper sheet conveying speed and the heating temperature;

FIG. 7B shows another data table for controlling of the paper sheet conveying speed and the heating temperature;

FIG. 8A shows a data table for controlling a print operation;

FIG. 8B shows another data table for controlling of the print operation;

FIG. 9A shows a data table for controlling a degaussing coil;

FIG. 9B shows another data table for controlling the degaussing coil; and

DESCRIPTION OF EMBODIMENTS

Hereinbelow, embodiments of the present invention will be described in details with reference to the drawings by way of illustration.

First Embodiment

Figure 1:
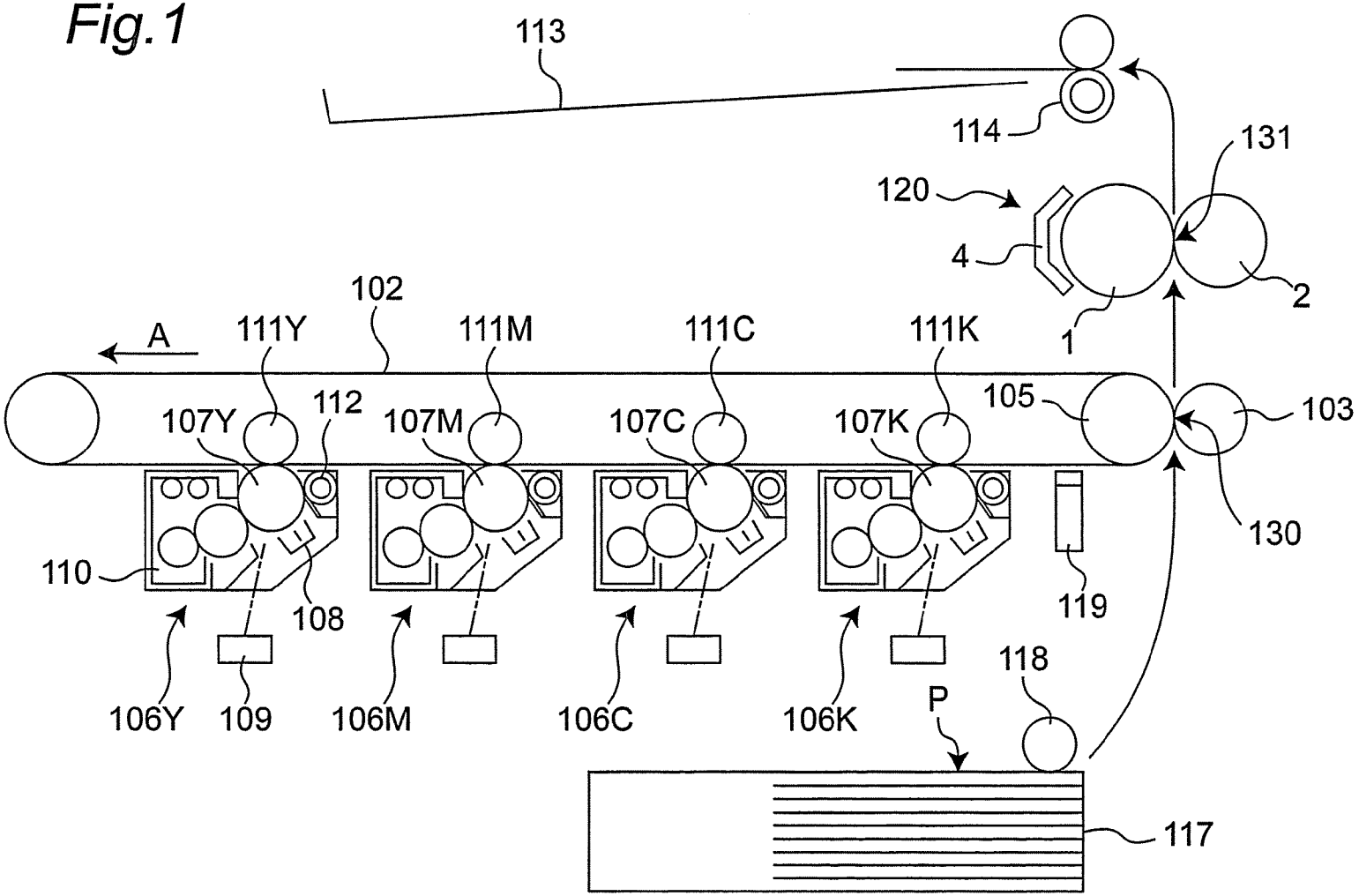
FIG. 1 shows a simplified structure view of an image forming apparatus in one embodiment of the invention.

An image forming apparatus schematically shown in FIG. 1 is a color printer. The image forming apparatus has an intermediate transfer belt 102 as a belt member in a generally central inner portion of the image forming apparatus. Under a lower horizontal portion of the intermediate transfer belt 102, four imaging units 106Y, 106M, 106C and 106K are juxtaposed along with the intermediate transfer belt 102, wherein the four imaging units 106Y, 106M, 106C and 106K respectively correspond to colors of yellow (Y), magenta (M), cyan (C) and black (K). The imaging units 106Y, 106M, 106C and 106K have photoconductor drums 107Y, 107M, 107C and 107K, respectively.

A charger 108, a print head section 109, a developing device 110, a primary transfer roller 111Y, 111M, 111C or 111K, and a cleaner 112 are placed in this order around the photoconductor drum 107Y, 107M, 107C or 107K along the rotation direction thereof. The primary transfer rollers 111Y, 111M, 111C and 111K respectively face the photoconductor drums 107Y, 107M, 107C and 107K across the intermediate transfer belt 102.

A portion of the intermediate transfer belt 102 supported by a driving roller 105 is put in pressure contact with a secondary transfer roller 103. A nip section is formed by the secondary transfer roller 103 and the intermediate transfer belt 102 so as to form a secondary transfer region 130.

A fixing device 120 is placed on a paper conveying path located downstream of the secondary transfer region 130. The fixing device 120 has a fixing roller 1, a pressure roller 2 and an electromagnetic induction heating section 4. A pressure contact part between the fixing roller 1 and the pressure roller 2 serves as a fixing nip area 131.

A picture paper cassette 117 is detachably placed in a lower part of the image forming apparatus. A stack of paper sheets P are stored in the picture paper cassette 117. The paper sheets are sent out one by one from a topmost paper sheet into the conveying path by rotation of a feed roller 118.

An AIDC (Auto Image Density Control) sensor 119, which serves as a resist sensor as well, is placed in between the secondary transfer region 130 and the imaging unit 106K located most downstream of the intermediate transfer belt 102.

Description is now given on operation of the above-structured image forming apparatus.

Upon reception of an image signal input from an external unit (e.g., personal computer) into an image signal processing section (not shown) of the image forming apparatus, the image signal processing section converts the image signal into digital image signals of yellow (Y), magenta (M), cyan (C) and black (K). Based on the input digital signals, print head sections 109 of the respective imaging units 106Y, 106M, 106C and 106K are made to emit light for exposure.

Accordingly, electrostatic latent images formed on the respective photoconductor drums 107Y, 107M, 107C and 107K are developed by developing devices 110 into toner images of respective colors.

The toner images of respective colors are then superposed on top of the intermediate transfer belt 102 to be primarily transferred due to the function of the primary transfer rollers 111Y, 111M, 111C, and 111K, while the intermediate transfer belt 102 moves in an arrow A direction.

Thus, the toner images formed on the intermediate transfer belt 102 reach the secondary transfer region 130 by movement of the intermediate transfer belt 102. The superposed toner images of respective colors are secondarily transferred together onto a paper sheet P in the secondary transfer region 130 by the function of the secondary transfer roller 103.

The toner images secondarily transferred onto the paper sheet P then reach the fixing nip area 131. In the fixing nip area 131, the toner images are fixed onto the paper sheet P by the fixing roller 1, which is induction-heated by the electromagnetic induction heating section 4, and the pressure roller 2.

The paper sheet P on which the toner images are fixed is then discharged into a paper ejection tray 113 via a paper ejecting roller 114.

Figure 2:
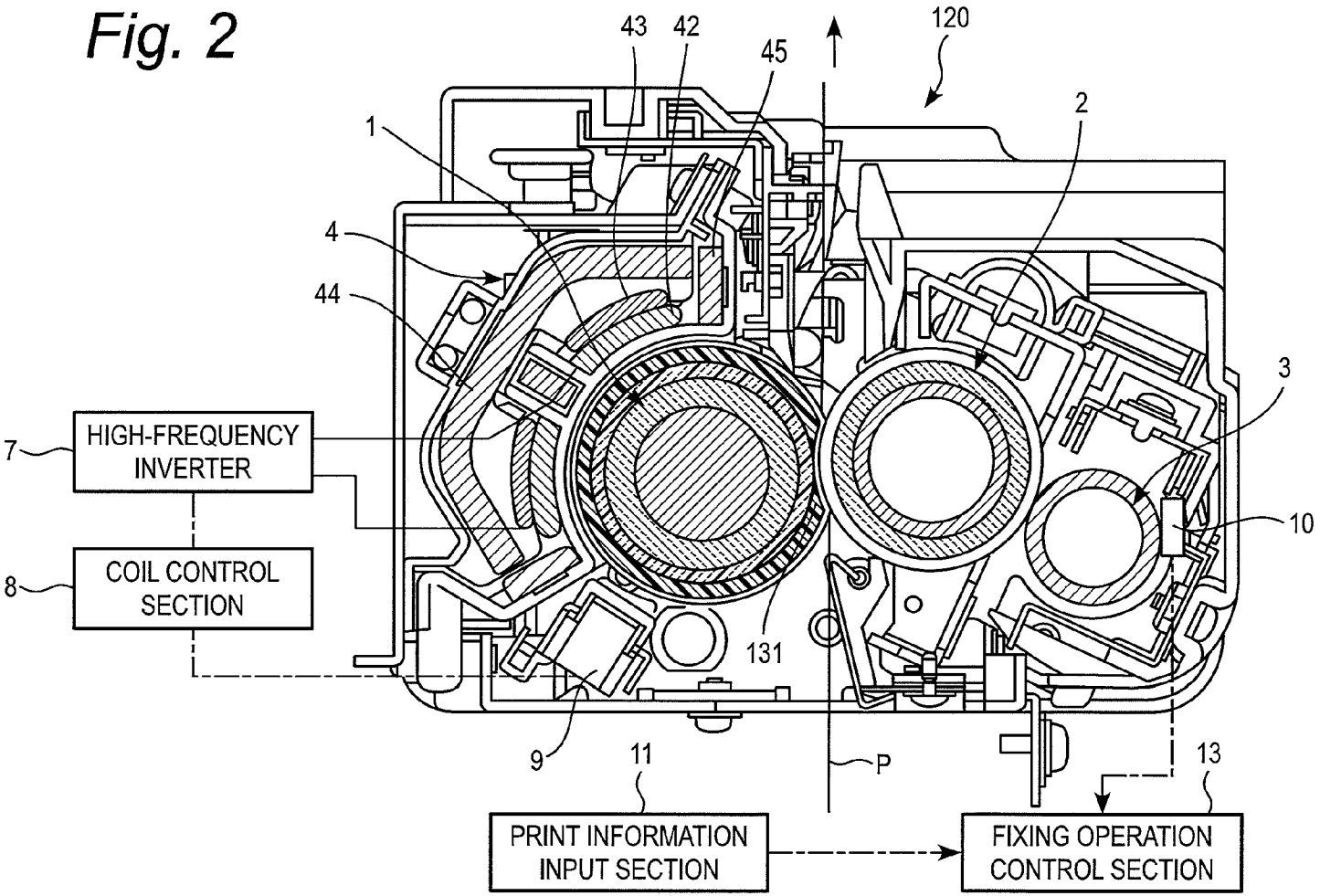
FIG. 2 shows a cross-sectional structure view of a fixing device in one embodiment of the invention.
Figure 3:
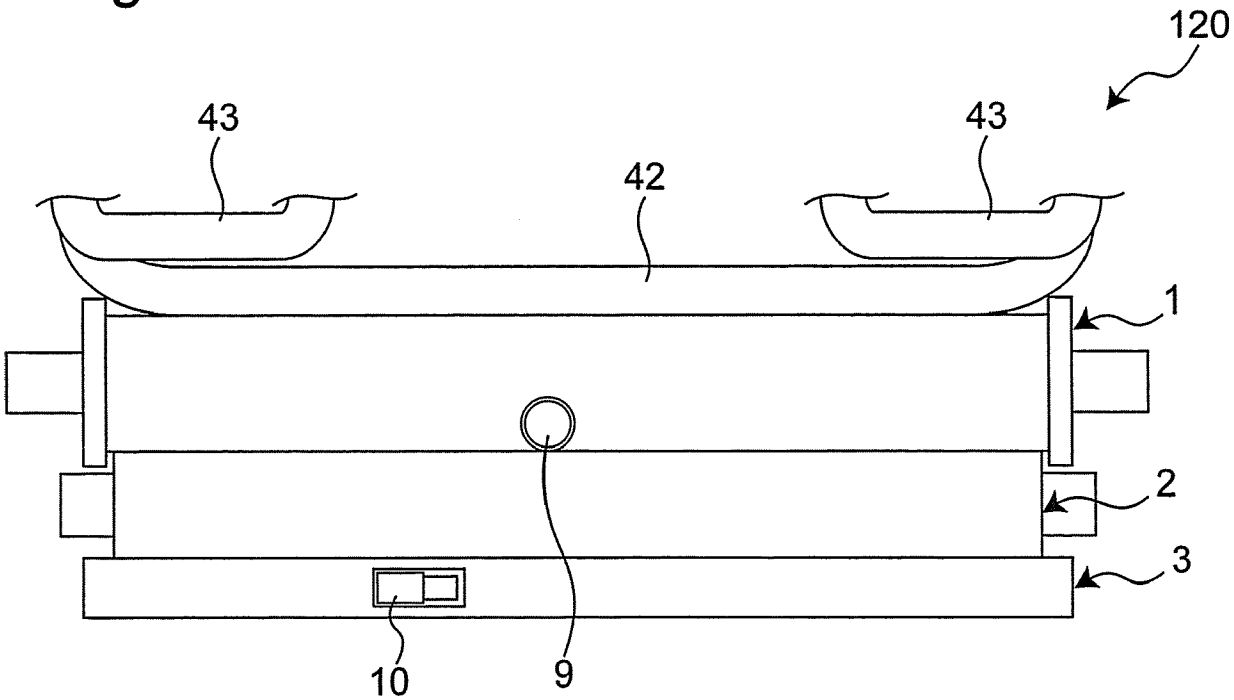
FIG. 3 shows a simplified view of the fixing device.

As shown in FIGS. 2 and 3, the fixing device 120 is composed of a fixing roller 1 as a fixing-side rotation unit, a pressure roller 2 as a pressure-side rotation unit, a soaking roller 3 as a soaking member, and an electromagnetic induction heating section 4 as a heating section.

The fixing roller 1 and the pressure roller 2 contact with each other to convey the paper sheet P as a recording material while fixing the toner on the paper sheet P. Incidentally, an overhead projector (OHP) sheet as well as the paper sheet P may be used as the recording material.

The fixing roller 1 has a cored bar layer, a heat insulating layer, an electromagnetic induction exothermic layer, an elastic layer and a releasing layer which are placed in this order from inside. The pressure roller 2 has a cored bar layer, a heat insulating layer and a releasing layer which are placed in this order from inside.

The fixing roller 1 is heated by using the electromagnetic induction heating section 4. Specifically, the electromagnetic induction heating section 4 heats the electromagnetic induction exothermic layer of the fixing roller 1.

The soaking roller 3 contacts the pressure roller 2. This contact assists heat transfer between the surfaces of the fixing roller 1 and the pressure roller 2 and equalizes the surface temperatures of the fixing roller 1 and the pressure roller 2. In other words, the soaking roller 3 suppresses uneven temperature distributions of the fixing roller 1 and the pressure roller 2 in the axial direction thereof. The soaking roller 3 is a metallic roller made of an aluminum base material or a copper base material, for example.

The fixing roller 1, the pressure roller 2 and the soaking roller 3 are arranged in parallel with each other. Both end portions of each of those rollers are rotatably supported by unshown bearing members.

The pressure roller 2 is biased toward the fixing roller 1 by an unshown pressurizing mechanism such as springs, so that the fixing nip area 131 is formed by the fixing roller 1 and the pressure roller 2. The soaking roller 3 is also put in pressure contact with the pressure roller 2 in a similar manner.

The pressure roller 2 is rotated clockwise at a predetermined circumferential speed by an unshown drive mechanism. The fixing roller 1 is rotated following after rotation of the pressure roller 2 by frictional force due to pressure contact with the pressure roller 2 in the fixing nip area 131. The soaking roller 3 is also rotated similarly by frictional force due to pressure contact of the pressure roller 2.

The surface temperature of the fixing roller 1 is detected by a temperature sensor 9. Signals of the temperature sensor 9 are input into a coil control section 8. The temperature sensor 9 is, for example, a noncontact-type infrared sensor. The temperature sensor 9 is placed at the axially central portion of the fixing roller 1.

The coil control section 8 controls heating and temperature of the fixing roller 1 based on the signal of the temperature sensor 9. Specifically, based on the signal of the temperature sensor 9, the coil control section 8 controls a high-frequency inverter 7 so as to increase or decrease electric power supply from the high-frequency inverter 7 to the electromagnetic induction heating section 4. Thereby, the surface temperature of the fixing roller 1 is automatically controlled to be kept constant.

The electromagnetic induction heating section 4 has an exciting coil 42, a degaussing coil 43, and cores 44 and 45. The exciting coil 42 is so structured that a lead wire is coiled along the longitudinal (i.e. axial) direction of the fixing roller 1. The exciting coil 42 is connected to the high-frequency inverter 7 and receives high-frequency power of 10 to 100 kHz and 100 to 2000 W. The exciting coil 42 is formed from a litz wire composed of tens to hundreds of bundled thin wires coated with heat-resistant resin.

The degaussing coil 43 is rolled along the longitudinal direction of the exciting coil 42 and placed on both longitudinal ends of the fixing roller 1 with reference to the longitudinal center of the fixing roller 1 where the paper sheets are conveyed.

The magnetic flux induced by the exciting coil 42 passes through the inside of a main core 44 and edge cores 45 and travels through the electromagnetic induction exothermic layer of the fixing roller 1. Thereby, eddy current is induced in the electromagnetic induction exothermic layer to generate Joule heat.

The exciting coil 42 and the degaussing coil 43 are connected to the high-frequency inverter 7 having a change switch. In feeding large-size paper sheets P, only the exciting coil 42 is operated, and the degaussing coil 43 does not function as a coil.

The degaussing coil 43 functions as an excessive temperature rise suppression section in such a way as to suppress excessive temperature rise in non-paper feed areas of a small-size paper sheet P in the contact part between the fixing roller 1 and the pressure roller 2. The word "non-paper feed area" is herein defined as an axial outer area of the contact part between the fixing roller 1 and the pressure roller 2 than an area of the contact part where the small-size paper sheet P passes. The word "small-size paper sheet" refers to a paper sheet having a width smaller than a maximum-size paper sheet. In this fixing device, at least two kinds of paper sheets can be used to fix toner thereon: a large-size paper sheet and a small-size paper sheet whose width (length in the axial direction of the fixing roller 1) is narrower than that of the large-size paper sheet.

When it is determined based on the temperature of the soaking roller 3 measured by the temperature measurement section 10 that the temperature of the non-paper feed area is increased due to feeding of the paper sheets P, the degaussing coil 43 is operated to generate a magnetic field in the direction of disturbing the magnetic field of the exciting coil 42 so as to achieve the demagnetization effect. As a result, the power of the magnetic field generated from the exciting coil 42 is decreased only in an area where the degaussing coil 43 is present, so that the heat value of the fixing roller 1 is decreased only in the range where the degaussing coil 43 exists. In other words, placement of the degaussing coil 43 makes it possible to reduce excessive temperature rise in the non-paper feed area (rise of the temperature in the end portions) at the time of feeding the small-size paper sheets P. In the case where a few small-size paper sheets P are fed for fixing operation after large-size paper sheets P are fed, and then large-size paper sheets P are fed again, the end portions do not suffer temperature fall, and toner can sufficiently be fixed on the large-size paper sheets P. Since a small number of the small-size paper sheets P are fed in the above case, the problem of excessive temperature rise in the end portions does not arise.

The fixing device 120 has a temperature measurement section 10, a print information input section 11 and a fixing operation control section 13.

The temperature measurement section 10 measures the temperature of the soaking roller 3. The temperature measurement section 10 is a noncontact temperature sensor which does not contact with the soaking roller 3.

The print information input section 11 inputs print information of the paper sheets P. The print information of the paper sheet P may be manually input in advance in the print information input section 11, or the print information of the paper sheet P may be automatically input in response to a signal from a size sensor provided in a feed section. The phrase "print information of the paper sheet" herein refers to, for example, the size of the paper sheet, the kind of the paper sheet, the basis weight of the paper sheet, the amount of toner adhering to the paper sheet and the like.

The fixing operation control section 13 controls fixing operation based on the print information input by the print information input section 11 and the temperature of the soaking roller 3 measured by the temperature measurement section 10.

The phrase "control of fixing operation" herein refers to, for example, controlling a conveyance interval of continuously conveyed paper sheets P, controlling a conveying speed of the paper sheets P, controlling a heating temperature of the electromagnetic induction heating section 4, controlling stop or start of fixing operation, controlling operation of the electromagnetic induction heating section 4 and the like. The phrase "controlling operation of the electromagnetic induction heating section 4" refers to, for example, controlling ON or OFF of a degaussing coil when the electromagnetic induction heating section 4 includes the degaussing coil, or refers to controlling ON or OFF of a degaussing shield when the electromagnetic induction heating section 4 includes the degaussing shield.

Description is now given on fixing operation. When the pressure roller 2 is rotated, the fixing roller 1 is rotated following after the rotation of the pressure roller 2. The fixing roller 1 is heated by using the electromagnetic induction heating section 4 so as to put the fixing roller 1 under automatic control to keep the surface temperature constant. In this state, a paper sheet P carrying an unfixed toner image is introduced into the fixing nip area 131 formed between the fixing roller 1 and the pressure roller 2. In this case, the face of the paper sheet P carrying the unfixed image faces the fixing roller 1.

The paper sheet P introduced into the fixing nip area 131 between the fixing roller 1 and the pressure roller 2 is conveyed in the state of being held in the fixing nip area 131 while being heated by the fixing roller 1. Thereby, the unfixed toner image is melt and fixed onto the paper sheet P, and then the paper sheet P is discharged.

In the case of printing maximum-size paper sheets, printing is performed while the temperature of the fixing roller 1 is controlled to reach target temperature by the temperature sensor 9, and while the paper sheet interval and the conveying speed are controlled to maintain predetermined values.

In the case of feeding small-size paper sheets, the fixing operation control section 13 estimates the state of temperature rise in the fixing roller 1 based on the temperature of the soaking roller 3 measured by the temperature measurement section 10, and controls the fixing roller 1 by switching over the target temperature of the fixing roller 1, the paper interval, the conveying speed and the like based on the temperature of the soaking roller 3 and the print information of the paper sheet P in such a way that the temperature of the non-paper feed area of the fixing roller 1 may not exceed a prescribed temperature.

According to the above-structured fixing device, the temperature of the soaking roller 3 which is in contact with the pressure roller 2 is measured. The soaking member 3 is excellent in thermal conductivity, so that the soaking roller 3 maintains generally flat axial temperature distribution even when small-size paper sheets P are continuously fed. Therefore, measuring the temperature of a part of the soaking roller 3 makes it possible to identify the temperature distribution of the entire regions of the fixing roller 1 and the pressure roller 2. In short, it becomes possible to estimate the temperature distribution state of the fixing roller 1 and the pressure roller 2 including the non-paper feed area of the paper sheet P with sufficient precision.

The fixing operation is controlled based on the print information input by the print information input section 11 and the temperature of the soaking roller 3 measured by the temperature measurement section 10. Therefore, optimal control can be implemented that suppresses the temperature rise in the non-paper feed area, based on the estimated temperature distribution state of the fixing roller 1 and the pressure roller 2. This makes it possible to prevent damage on the fixing device without reducing user-friendliness more than necessary.

The above-structured image forming apparatus has the fixing device, so that durability of the image forming apparatus can be enhanced.

It should be noted that the temperature of the non-paper feed area increases in proportion to the paper size (width size), the basis weight of paper sheets, the toner adhering amount, and the number of continuously fed paper sheets.

In addition, the print information input section 11 is not indispensable. The fixing operation may be controlled by using the fixing operation control section 13, based on only the temperature of the soaking roller 3 measured by the temperature measurement section 10.

Description is now given on specific fixing operation by the fixing operation control section 13 with reference to FIGS. 4A to 9B. FIGS. 4A, 5A, . . . , 9A show examples of simplified control regardless of the paper size. FIGS. 4B, 5B, . . . , 9B show further developed examples of FIGS. 4A, 5A, . . . , 9A involving print information.

FIGS. 4A and 4B show control of a conveyance interval (paper sheet interval) of continuously conveyed paper sheets P. FIGS. 4A and 4B show control data as a table. These data are stored in the fixing operation control section 13.

In FIG. 4A, the paper sheet interval when the temperature of the soaking roller 3 is smaller than 95° C. is used as a standard paper sheet interval. When the temperature of the soaking roller 3 is higher than 125° C., the paper sheet interval is set 4 times the standard paper sheet interval by using the fixing operation control section 13. In short, the fixing operation control section 13 makes the paper sheet interval larger as the temperature of the soaking roller 3 is higher. In FIG. 4A, the paper size (width size) as print information is not used as an element of control. All the paper sizes are 90 to 265 mm in width.

In FIG. 4B, the print information includes various paper sizes (width sizes). The paper sheet interval when the temperature of the soaking roller 3 is smaller than 95° C. is used as a standard paper sheet interval. When the temperature of the soaking roller 3 is higher than 125° C. and when the paper size (width size) is small size (90 to 145 mm), the paper sheet interval is set 4 times the standard paper sheet interval by using the fixing operation control section 13. In short, the fixing operation control section 13 makes the paper sheet interval larger as the temperature of the soaking roller 3 is higher. The fixing operation control section 13 also makes the paper sheet interval larger as the paper size is smaller.

Therefore, the temperature rise can easily be suppressed in the non-paper feed area, as shown in FIGS. 4A and 4B.

FIGS. 5A and 5B show control of the conveying speed of continuously conveyed paper sheets P (paper sheet conveying speed). FIGS. 5A and 5B show control data as a table. These data are stored in the fixing operation control section 13.

In FIG. 5A, the paper sheet conveying speed when the temperature of the soaking roller 3 is smaller than 95° C. is used as a standard conveying speed. When the temperature of the soaking roller 3 is higher than 125° C., the conveying speed is set 0.6 times the standard conveying speed by using the fixing operation control section 13. In short, the fixing operation control section 13 makes the conveying speed slower as the temperature of the soaking roller 3 is higher. In FIG. 5A, the paper size (width size) as print information is not used as an element of control. All the paper sizes are 90 to 265 mm in width.

In FIG. 5B, the print information includes various paper sizes (width sizes). The paper sheet conveying speed when the temperature of the soaking roller 3 is smaller than 95° C. is used as a standard conveying speed. When the temperature of the soaking roller 3 is higher than 125° C. and when the paper size (width size) is small size (90 to 145 mm), the conveying speed is set 0.6 times the standard conveying speed by using the fixing operation control section 13. In short, the fixing operation control section 13 makes the conveying speed slower as the temperature of the soaking roller 3 is higher. The fixing operation control section 13 also makes the conveying speed slower as the paper size is smaller.

Therefore, as shown in FIGS. 5A and 5B, the temperature rise can easily be suppressed in the non-paper feed area.

FIGS. 6A and 6B show control of the heating temperature (heating temperature) of the electromagnetic induction heating section 4. FIGS. 6A and 6B show control data as a table. These data are stored in the fixing operation control section 13.

In FIG. 6A, the heating temperature when the temperature of the soaking roller 3 is smaller than 95° C. is used as a standard heating temperature. When the temperature of the soaking roller 3 is higher than 125° C., the heating temperature is set 5° C. lower than the standard heating temperature by using the fixing operation control section 13. In short, the fixing operation control section 13 makes the heating temperature lower as the temperature of the soaking roller 3 is higher. In FIG. 6A, the paper size (width size) as print information is not used as an element of control. All the paper sizes are 90 to 265 mm in width.

In FIG. 6B, the print information includes various paper sizes (width sizes). The heating temperature when the temperature of the soaking roller 3 is smaller than 95° C. is used as a standard heating temperature. When the temperature of the soaking roller 3 is higher than 125° C. and when the paper size (width size) is small size (90 to 145 mm), the heating temperature is set 5° C. lower than the standard heating temperature by using the fixing operation control section 13. In short, the fixing operation control section 13 makes the heating temperature lower as the temperature of the soaking roller 3 is higher. The fixing operation control section 13 also makes the heating temperature lower as the paper size is smaller.

Therefore, as shown in FIGS. 6A and 6B, the temperature rise can easily be suppressed in the non-paper feed area.

FIGS. 7A and 7B show control of the conveying speed (paper sheet conveying speed) of continuously conveyed paper sheets P and control of the heating temperature (heating temperature) of the electromagnetic induction heating section 4. FIGS. 7A and 7B show control data as a table. These data are stored in the fixing operation control section 13.

In FIG. 7A, the paper sheet conveying speed when the temperature of the soaking roller 3 is smaller than 95° C. is used as a standard conveying speed. When the temperature of the soaking roller 3 is higher than 125° C., the conveying speed is set 0.8 times the standard conveying speed by using the fixing operation control section 13. Further, the heating temperature when the temperature of the soaking roller 3 is smaller than 95° C. is used as a standard heating temperature. When the temperature of the soaking roller 3 is higher than 125° C., the heating temperature is set 15° C. lower than the standard heating temperature by using the fixing operation control section 13. In short, the fixing operation control section 13 makes the conveying speed slower and the heating temperature lower as the temperature of the soaking roller 3 is higher. In FIG. 7A, the paper size (width size) as print information is not used as an element of control. All the paper sizes are 90 to 265 mm in width.

In FIG. 7B, the print information includes various paper sizes (width sizes). The conveying speed when the temperature of the soaking roller 3 is smaller than 95° C. is used as a standard conveying speed. When the temperature of the soaking roller 3 is higher than 125° C. and when the paper size (width size) is small size (90 to 145 mm), the conveying speed is set 0.8 times the standard conveying speed by using the fixing operation control section 13. Further, the heating temperature when the temperature of the soaking roller 3 is smaller than 95° C. is used as a standard heating temperature. When the temperature of the soaking roller 3 is higher than 125° C. and when the paper size (width size) is small size (90 to 145 mm), the heating temperature is set 15° C. lower than the standard heating temperature by using the fixing operation control section 13. In short, the fixing operation control section 13 makes the conveying speed slower and the heating temperature lower, as the temperature of the soaking roller 3 is higher. Also, the fixing operation control section 13 makes the conveying speed slower and the heating temperature lower, as the temperature of the soaking roller 3 is higher.

Therefore, as shown in FIGS. 7A and 7B, the temperature rise can easily be suppressed in the non-paper feed area.

FIGS. 8A and 8B show control of fixing operation (print operation). FIGS. 8A and 8B show control data as a table. These data are stored in the fixing operation control section 13.

In FIG. 8A, when the temperature of the soaking roller 3 is smaller than 85° C., print operation is maintained in printing, whereas print operation is restarted in printing stop. When the temperature of the soaking roller 3 is higher than 125° C., print operation is temporarily stopped in printing, whereas the temporary stop is maintained in temporary stop of the print operation. In short, the fixing operation control section 13 stops fixing operation (print operation) when the temperature of the soaking roller 3 is higher than a set value of data. In FIG. 8A, the paper size (width size) as print information is not used as an element of control. All the paper sizes are 90 to 265 mm in width.

In FIG. 8B, the print information includes various paper sizes (width sizes). When the temperature of the soaking roller 3 is smaller than 85° C., print operation is maintained in printing, whereas print operation is restarted in printing stop. When the temperature of the soaking roller 3 is higher than 125° C. and when the paper size (width size) is small size (90 to 145 mm), print operation is temporarily stopped in printing, whereas the temporary stop is maintained in temporary stop of the print operation. In short, the fixing operation control section 13 stops fixing operation (print operation) when the temperature of the soaking roller 3 is higher than a set value of data. Also, the fixing operation control section 13 stops fixing operation (print operation) when the paper size is smaller than a set value of data.

Therefore, as shown in FIGS. 8A and 8B, the temperature rise can easily be suppressed in the non-paper feed area.

FIGS. 9A and 9B show control of the degaussing coil 43 (excessive temperature rise suppression section). FIGS. 9A and 9B show control data as a table. These data are stored in the fixing operation control section 13.

In FIG. 9A, when the temperature of the soaking roller 3 is smaller than 95° C., operation of the degaussing coil 43 is stopped. When the temperature of the soaking roller 3 is higher than 95° C., operation of the degaussing coil 43 is started. In short, the fixing operation control section 13 starts operation of the degaussing coil 43 when the temperature of the soaking roller 3 is higher than a set value of data. In FIG. 9A, the paper size (width size) as print information is not used as an element of control. All the paper sizes are 90 to 265 mm in width.

In FIG. 9B, the print information includes various paper sizes (width sizes). When the temperature of the soaking roller 3 is smaller than 95° C., operation of the degaussing coil 43 is stopped. When the temperature of the soaking roller 3 is higher than 125° C. and when the paper size (width size) is small size (90 to 145 mm), operation of the degaussing coil 43 is started. In short, the fixing operation control section 13 starts operation of the degaussing coil 43 when the temperature of the soaking roller 3 is higher than a set value of data. Also, the fixing operation control section 13 starts operation of the degaussing coil 43 when the paper size is smaller than a set value of data.

Therefore, as shown in FIGS. 9A and 9B, the temperature rise can easily be suppressed in the non-paper feed area.

Second Embodiment

Figure 10:
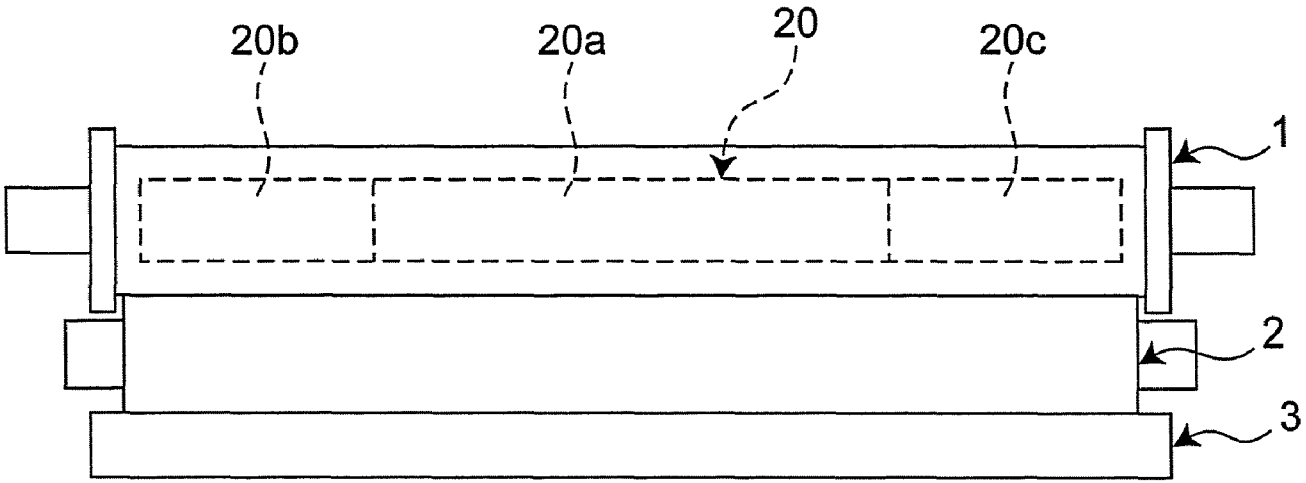
FIG. 10 shows a simplified structure view of the fixing device in another embodiment of the present invention.

FIG. 10 shows a fixing device in a second embodiment of the present invention. The second embodiment is different from the first embodiment in structure of the heating section. Other structures than the heating section are identical to those in the first embodiment, and therefore, the description thereof is omitted.

As shown in FIG. 10, a heater 20 is used as a heating section. The heater 20 is placed inside the fixing roller 1 for heating the fixing roller 1.

The heater 20 has a central heater 20*a* for heating an axially central portion of the fixing roller 1 and end heaters 20*b*, 20*c* for heating both the axial end portions of the fixing roller 1.

The central heater 20*a* heats the paper feed area of the small-size paper sheet P in the contact part between the fixing roller 1 and the pressure roller 2. The end heaters 20*b*, 20*c* heat the non-paper feed area of the small-size paper sheet P in the contact part between the fixing roller 1 and the pressure roller 2.

Operation of the central heater 20*a* and operation of the end heaters 20*b*, 20*c* may be controlled independently of each other.

The fixing operation control section 13 stops operation of the end heaters 20*b*, 20*c* when the temperature of the soaking roller 3 is higher than a set value of data. Therefore, the temperature rise can easily be suppressed in the non-paper feed area.

The present invention shall not be limited to the above-disclosed embodiments. For example, a heat pipe may be used instead of the soaking roller 3 as a soaking member. The soaking member may contact with the fixing-side rotation unit in addition to the pressure-side rotation unit.

The temperature measurement section 10 may be placed on an end portion of the soaking roller 3 as a contact-type temperature sensor which contacts the soaking roller 3.

A degaussing shield besides the degaussing coil 43 may be used as the excessive temperature rise suppression section. The degaussing shield is placed in the non-paper feed area between the electromagnetic induction heating section 4 and the fixing roller 1 so as to intercept the magnetic flux which travels from the exciting coil 42 of the electromagnetic induction heating section 4 to the non-paper feed area of the fixing roller 1.

The fixing-side rotation unit and the pressure-side rotation unit may be formed into a belt shape instead of the roller shape.

Although the fixing operation was controlled with use of the data shown in FIG. 4A to FIG. 9B, the fixing operation may be controlled with use of data obtained by calculation of input values.

The fixing device has two degaussing coils in the above description. However, the fixing device may be structured to support paper sheets of a plurality of sizes, such as large-size, middle-size and small-size. In that case, more than two degaussing coils may be provided so as to execute control corresponding to the sizes of paper sheets.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

REFERENCE SIGNS LIST

1: fixing roller (fixing-side rotation unit)
2: pressure roller (pressure-side rotation unit)
3: soaking roller (soaking member)
4: electromagnetic induction heating section (heating section)
7: high-frequency inverter
8: coil control section
9: temperature sensor
10: temperature measurement section
11: print information input section
13: fixing operation control section
20: heater (heating section)
42: exciting coil
43: degaussing coil
45: edge core Citation List Patent Literature Reference 1: JP 10-74017 A

The invention claimed is:

1. A fixing device comprising:

a fixing-side rotation unit and a pressure-side rotation unit which contact with each other to convey a recording material while fixing toner on the recording material;

a heating section for heating the fixing-side rotation unit;

a soaking member which contacts with the fixing-side rotation unit or the pressure-side rotation unit and suppresses uneven temperature distributions in an axial direction of the fixing-side rotation unit and the pressure-side rotation unit by assisting heat transfer between the surface of the fixing-side rotation unit and the surface of the pressure-side rotation unit;

a temperature measurement section for measuring temperature of the soaking member; and a fixing operation control section for controlling a fixing operation based on the temperature of the soaking member measured by the temperature measurement section.

2. The fixing device set forth in claim 1, further comprising:

a print information input section for inputting print information of the recording material, wherein the fixing operation control section controls the fixing operation based on the print information input by the print information input section and the temperature of the soaking member measured by the temperature measurement section.

3. The fixing device set forth in claim 1, wherein the fixing operation control section makes a conveyance interval of continuously conveyed recording materials larger as the temperature of the soaking member is higher.

4. The fixing device set forth in claim 1, wherein the fixing operation control section makes a conveying speed of the recording materials slower as the temperature of the soaking member is higher.

5. The fixing device set forth in claim 1, wherein the fixing operation control section stops the fixing operation when the temperature of the soaking member is high.

6. The fixing device set forth in claim 5, wherein the fixing operation control section restarts the fixing operation when the temperature of the soaking member is a predetermined value or less.

7. The fixing device set forth in claim 1, wherein the heating section has an excessive temperature rise suppression section for suppressing excessive temperature rise in a non-paper feed area outside of an area where a small-size recording material passes in a contact part between the fixing-side rotation unit and the pressure-side rotation unit, and the fixing operation control section starts operation of the excessive temperature rise suppression section when the temperature of the soaking member is high.

8. The fixing device set forth in claim 7, wherein the fixing operation control section starts operation of the excessive temperature rise suppression section when it is determined that the temperature of the soaking member is high so that the temperature of the non-paper feed area is high.

9. The fixing device set forth in claim 1, wherein the heating section includes:

a central heating section for heating an axially central portion of the fixing-side rotation unit; and an end heating section for heating each of both axial end portions of the fixing-side rotation unit, wherein the fixing operation control section stops operation of the end heating section when the temperature of the soaking member is high.

10. The fixing device set forth in claim 1, further comprising:

a second temperature measurement section for measuring surface temperature of a paper feed area of the fixing-side rotation unit; and a fixing control section for controlling the surface temperature of the paper feed area of the fixing-side rotation unit to be kept at a heating temperature by increasing or decreasing electric power supply to the heating section, based on the surface temperature of the paper feed area of the fixing-side rotation unit measured by the second temperature measurement section; wherein the fixing operation control section changes the fixing operation so as to suppress excessive temperature rise in a non-paper feed area of the fixing-side rotation unit in a state that control by the fixing control section is maintained, based on the temperature of the soaking member measured by the temperature measurement section.

11. The fixing device set forth in claim 1, wherein the temperature measurement section measures the temperature of the soaking member to estimate the temperature of a non-paper feed area of the fixing-side rotation unit.

12. The fixing device set forth in claim 1, wherein the heating section is provided outside of the fixing-side rotation unit and at a distance from the soaking member.

13. A fixing device comprising:

a fixing-side rotation unit and a pressure-side rotation unit which contact with each other to convey a recording material while fixing toner on the recording material;

a heating section for heating the fixing-side rotation unit;

a soaking member which contacts with the fixing-side rotation unit or the pressure-side rotation unit;

a temperature measurement section for measuring temperature of the soaking member; and a fixing operation control section for controlling a fixing operation based on the temperature of the soaking member measured by the temperature measurement section, wherein the fixing operation control section makes heating temperature of the heating section lower as the temperature of the soaking member is higher.

14. An image forming apparatus having a fixing device comprising:

a fixing-side rotation unit and a pressure-side rotation unit which contact with each other to convey a recording material while fixing toner on the recording material;

a heating section for heating the fixing-side rotation unit;

a soaking member which contacts with the fixing-side rotation unit or the pressure-side rotation unit and suppresses uneven temperature distributions in an axial direction of the fixing-side rotation unit and the pressure-side rotation unit by assisting heat transfer between the surface of the fixing-side rotation unit and the surface of the pressure-side rotation unit;

a temperature measurement section for measuring temperature of the soaking member; and a fixing operation control section for controlling a fixing operation based on the temperature of the soaking member measured by the temperature measurement section.

15. The image forming apparatus set forth in claim 14, wherein the fixing device further comprises:

a second temperature measurement section for measuring surface temperature of a paper feed area of the fixing-side rotation unit; and a fixing control section for controlling the surface temperature of the paper feed area of the fixing-side rotation unit to be kept at a heating temperature by increasing or decreasing electric power supply to the heating section, based on the surface temperature of the paper feed area of the fixing-side rotation unit measured by the second temperature measurement section; wherein the fixing operation control section changes the fixing operation so as to suppress excessive temperature rise in a non-paper feed area of the fixing-side rotation unit in a state that control by the fixing control section is maintained, based on the temperature of the soaking member measured by the temperature measurement section.

16. The image forming apparatus set forth in claim 14, wherein the temperature measurement section measures the temperature of the soaking member to estimate the temperature of a non-paper feed area of the fixing-side rotation unit.

17. The image forming apparatus set forth in claim 14, wherein the heating section is provided outside of the fixing-side rotation unit and at a distance from the soaking member.

* * * * *